US005778779A

United States Patent [19]

Jones et al.

[11] Patent Number: 5,778,779

[45] Date of Patent: Jul. 14, 1998

[54] PRINTING UNIT AND REGISTER MECHANISM FOR MOUNTING A PRINTING SLEEVE

[75] Inventors: Jackson H. Jones, Rochester; Robert R. Murray, Madbury; Roland Thomas Palmatier, Durham, all of N.H.

[73] Assignees: Heidelberger Druckmaschinen AG, Germany; Heidelberg Harris, Inc., Dover, N.H.

[21] Appl. No.: 665,134

[22] Filed: Jun. 14, 1996

Related U.S. Application Data

[63] Continuation of Ser. No. 582,712, Jan. 4, 1996, abandoned.

[51] Int. Cl.[6] ..... B41F 27/00

[52] U.S. Cl. ..... 101/216; 101/248; 101/375; 101/486; 101/DIG. 36

[58] Field of Search ..... 101/216, 217, 101/219, 178, 248, 375, 376, 415.1, 477, 483, 485, 486, DIG. 36

[56] References Cited

U.S. PATENT DOCUMENTS

| | | | |
|---|---|---|---|
| 4,119,032 | 10/1978 | Hollis | 101/216 |
| 4,913,048 | 4/1990 | Tittgemeyer | 101/216 |
| 4,936,211 | 6/1990 | Pensavecchia et al. | 101/136 |
| 4,991,503 | 2/1991 | Morner | 101/170 |
| 5,127,322 | 7/1992 | Kobler | 101/219 |
| 5,188,027 | 2/1993 | Fantoni | 101/216 |
| 5,241,905 | 9/1993 | Guaraldi et al. | 101/216 |
| 5,277,112 | 1/1994 | Ohta et al. | 101/425 |
| 5,323,702 | 6/1994 | Vrotacoe et al. | 101/217 |
| 5,370,047 | 12/1994 | Compton | 101/216 |
| 5,379,693 | 1/1995 | Hoffmann et al. | 101/375 |
| 5,385,093 | 1/1995 | Rogge et al. | 101/352 |
| 5,388,511 | 2/1995 | Iijima | 101/483 |
| 5,490,461 | 2/1996 | Beaudoin | 101/219 |
| 5,492,062 | 2/1996 | Harris et al. | 101/486 |
| 5,551,339 | 9/1996 | Schädlich et al. | 101/216 |
| 5,596,926 | 1/1997 | Zimmer | 101/DIG. 36 |

FOREIGN PATENT DOCUMENTS

| | | |
|---|---|---|
| 0 225 509 B1 | 6/1987 | European Pat. Off. . |
| 0 510 744 | 10/1992 | European Pat. Off. . |
| 43 41 246 | 2/1995 | Germany . |

*Primary Examiner*—Stephen R. Funk
*Attorney, Agent, or Firm*—Kenyon & Kenyon

[57] ABSTRACT

A printing unit for a web fed rotary printing press for printing newspapers is provided in which the central impression cylinder (2) is commonly rotatably mounted in the two side walls (14*a*, 14*b*) of the housing (14) of the printing press and the blanket cylinder (4) and/or print cylinder (6) are rotatably cantilevered on one end in the first side wall (14*a*) during the make ready operation of the printing press, allowing a quick and easy changing of the cylinders (4, 6) via an opening (30) formed in the second side wall (14*b*). When the printing press is in operation the blanket and print cylinders (4, 6) may be additionally rotatably supported in a side plate (32) fitted to the opening (30), or may remain unsupported on their other ends.

4 Claims, 9 Drawing Sheets

60
6
50
52
62
66
68
21
70
71
69
56
44

PRINTING UNIT AND REGISTER MECHANISM FOR MOUNTING A PRINTING SLEEVE

This is a continuation of application Ser. No. 08/582,712, entitled Printing Unit for a Web Fed Rotary Printing Press, filed on Jan. 4, 1996 now abandoned.

FIELD OF THE INVENTION

The present invention is related to a printing unit for a web fed rotary printing press.

BACKGROUND OF THE INVENTION

U.S. Pat. No. 5,127,322 purports to describe a web fed rotary printing press including a satellite printing unit with a central impression cylinder and four accompanying blanket cylinders. A corresponding plate cylinder is engaged with each blanket cylinder. A web is fed downwardly through the printing unit, wound around the central impression cylinder, and exits upwardly through the printing unit. For changing the plates mounted on the plate cylinders, a moveable robot arm is provided. The system purports to provide for rapid mounting and removal of printing plates.

U.S. Pat. No. 5,323,702 discloses a tubular printing blanket for a blanket cylinder in an offset printing press. The tubular printing blanket is axially mounted on, and removed from, a blanket cylinder. Conventional blankets and cylinders, which have a gap which moves through the nip between the blanket cylinder and the plate cylinder and between the blanket cylinder and the impression cylinder, cause vibrations and shock-loads throughout the printing unit, which detrimentally affects print quality. The use of the gapless tubular printing blanket enables a printing press to run at high speeds without excessive vibration or shock loads, with reduced slippage of printing surfaces which could smear the printed image, and without overheating.

EP 0 225 509 B1 purports to disclose an apparatus for indirectly printing on a web which includes three printing mechanism cylinders which are respectively mounted with their ends in the two side walls of a printing press. The plate cylinder as well as the blanket cylinder carry respective interchangeable sleeves. For changing the sleeve of the blanket cylinder, the printing press is stopped, the blanket cylinder is released from one of the associated side walls, and the sleeve is removed from or installed onto the cylinder.

SUMMARY OF THE INVENTION

In accordance with the present invention, a printing unit for a web fed rotary printing press comprises a housing with a first and a second housing section, a central impression cylinder supportingly mounted in the first and second housing section via a first and a second journal. The printing unit further comprises at least two blanket cylinders in rolling engagement with the central impression cylinder, and at least two print cylinders in rolling engagement with the blanket cylinders. The blanket cylinders are cantilevered in the first housing section, i.e. supported only by the first housing section, during a make ready operation of the printing unit.

Since the blanket cylinders are cantilevered during make-ready, sleeve shaped printing blankets may be axially mounted on, and removed from, the blanket cylinder. This reduces make ready as compared with conventionally mounted flat blankets. In addition, since the sleeve-shaped printing blanket has no gap in its outer surface, the vibrations and/or shock-loads which normally occur when the blanket cylinder rotates and the gap moves through the nip formed between the print cylinder and the blanket cylinder are eliminated. Thus, material wear and print defects from these vibrations and shock-loads are reduced in comparison with conventional satellite printing presses using conventional flat blankets, and press speeds of 3000 feet per minute are attainable.

In addition, the use of a cantilevered blanket cylinder provides greater accessibility to the printing unit during make-ready.

In accordance with a second embodiment of the present invention, the print cylinder is also cantilevered in the first housing section during make ready. This allows the use of sleeve-shaped print forms which can be quickly mounted axially on, and removed from, the print cylinder. It also provides even greater accessability to the printing unit during make ready. Another advantage of using sleeve-shaped print forms and blankets instead of conventional blankets and printing plates is that there is no gap in either the print form or the blanket to produce an unprinted area between two successive pages of a printed web. Consequently, if the sleeve-shaped print form is manufactured from a flat plate whose opposing ends are bonded together, the only unprintable area remaining on the web will be from the slight seam in the print form. If the sleeve-shaped print form is also seamless, then there will be no unprintable area on the web.

In accordance with a further embodiment of the present invention, the blanket and/or print cylinder are cantilevered in one side wall while the printing unit is in production, as well as while it is in make ready. This further reduces the time necessary for blanket and or print form changes because it eliminates the need for any releasing mechanism on the second housing section.

In accordance with a further embodiment of the present invention, the sleeve-shaped print forms and/or the sleeve shaped printing blankets are expanded by compressed air which is transmitted through apertures located on an outer circumferential surface of the blanket and/or the print cylinders in order to allow the print forms and/or printing blankets to be installed or removed from their respective cylinders.

In accordance with a still further embodiment of the present invention, an automatic register system is provided for automatically adjusting the circumferential register of the printing unit. An electric motor rotates a wheel which is in contact with the outer circumferential surface of the sleeve-shaped print form while the print form is expanded by compressed air. As the wheel rotates under the control of the electric motor, the sleeve-shaped print form is rotated about the print cylinder until circumferential register is achieved.

DETAILED DESCRIPTION OF THE INVENTION

Figure 1:
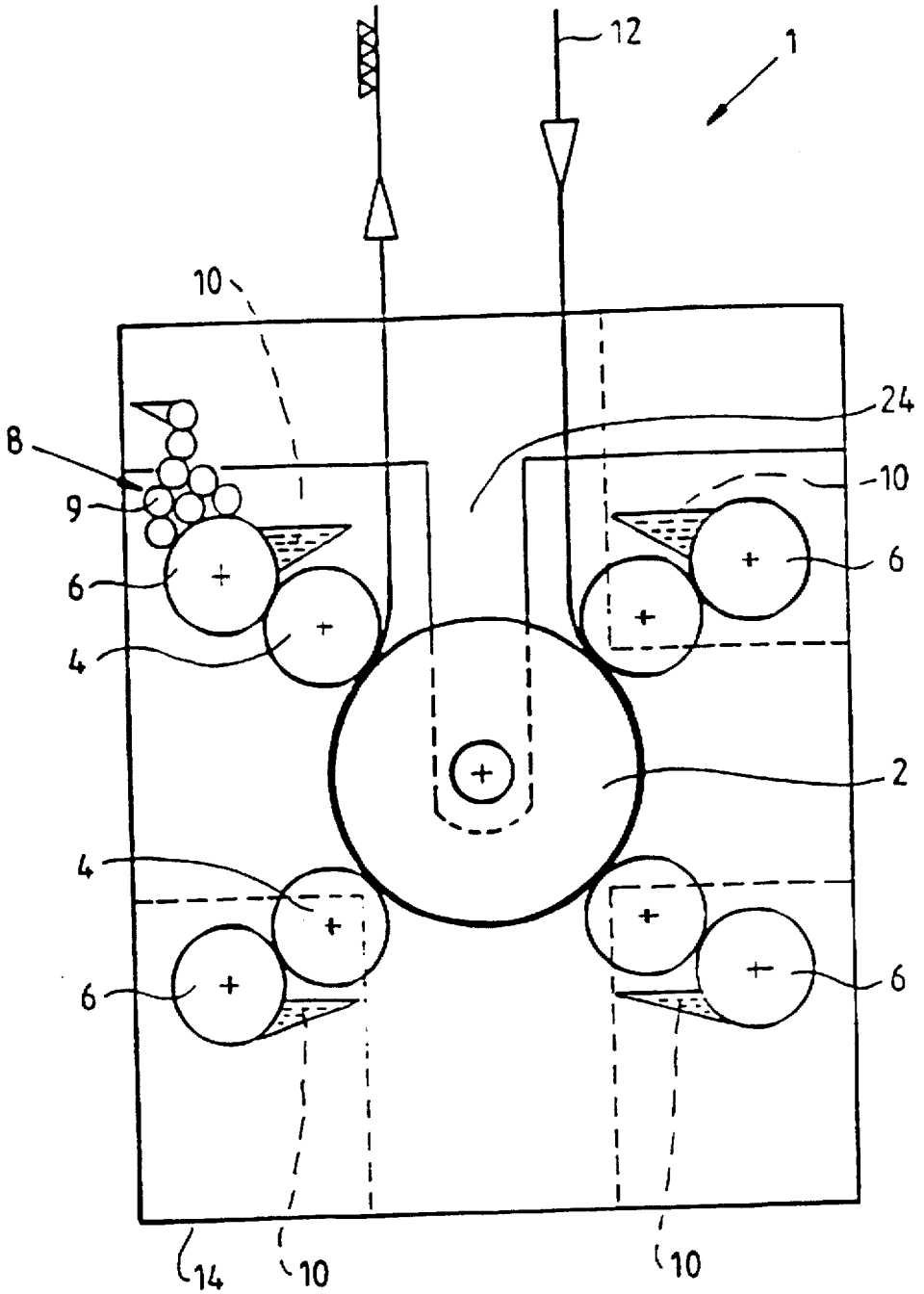
FIG. 1 shows a side view of a satellite printing unit in accordance with the present invention.

FIG. 1 shows a satellite printing unit 1 which is may be used, for example, in web fed rotary printing presses for printing newspapers. It comprises a central impression cylinder 2 located in the middle of the unit 1 and four blanket cylinders 4 in rolling engagement with the central impression cylinder 2. Four print cylinders 6 are disposed in rolling engagement with respective blanket cylinders 4. Each print cylinder is also in rolling engagement with a respective ink station 8 having ink rollers 9. The ratio of the circumference of the central impression cylinder to the blanket cylinders may be 2:1, 4:1, or any integer number. Although FIG. 1 shows only one ink station 8, it should be understood that there is a respective ink station 8 for each print cylinder 6. Each ink station 8 applies a different color to its associated print cylinder 6 so that, in the illustrated printing unit 1, four different colors, e.g. black, magenta, cyan, and yellow, can be printed on the web 12. Naturally, the printing unit 1 could alternatively be configured to print a fifth color, e.g. gold or some other specialty color, by providing an additional print cylinder 6, blanket cylinder 4, and inking station 8 disposed on the impression cylinder 2.

Additional colors can also be added by separating the ink stations such that an ink station can print two colors at once. For example, if the web 12 is more than one page wide, each print cylinder can have several ink stations associated therewith, with each ink station applying ink to a different page, or set of pages.

Dampening systems 10 are shown associated with each print cylinder 6. The dampening systems 10 apply dampening fluid to the plates 6 when the printing unit 1 is used for wet offset printing. When using the printing unit 1 for dry-offset, waterless or single fluid printing, the dampening systems 10 are not used. If the printing unit 1 is to be used exclusively for dry-offset printing, the dampening units 10 may be omitted completely.

The web 12 is fed into the printing unit 1 from a top entry of the printing unit 1, is wound around the central impression cylinder 2, through the nips formed between the blanket cylinders 4 and the central impression cylinder 2, and then leaves the printing unit 1 though the top entry. Naturally, the web 12 can also be fed into the printing unit 1 from the left, the right or bottom, and exit the printing unit in any desired direction. For example, in some applications, it might be desirable to have the web exit from a different direction than it entered. In order to alter the path of the web after it exits the last blanket cylinder, a low pressure air roller can be employed to change the web direction without smearing the image on the web.

Figure 2:
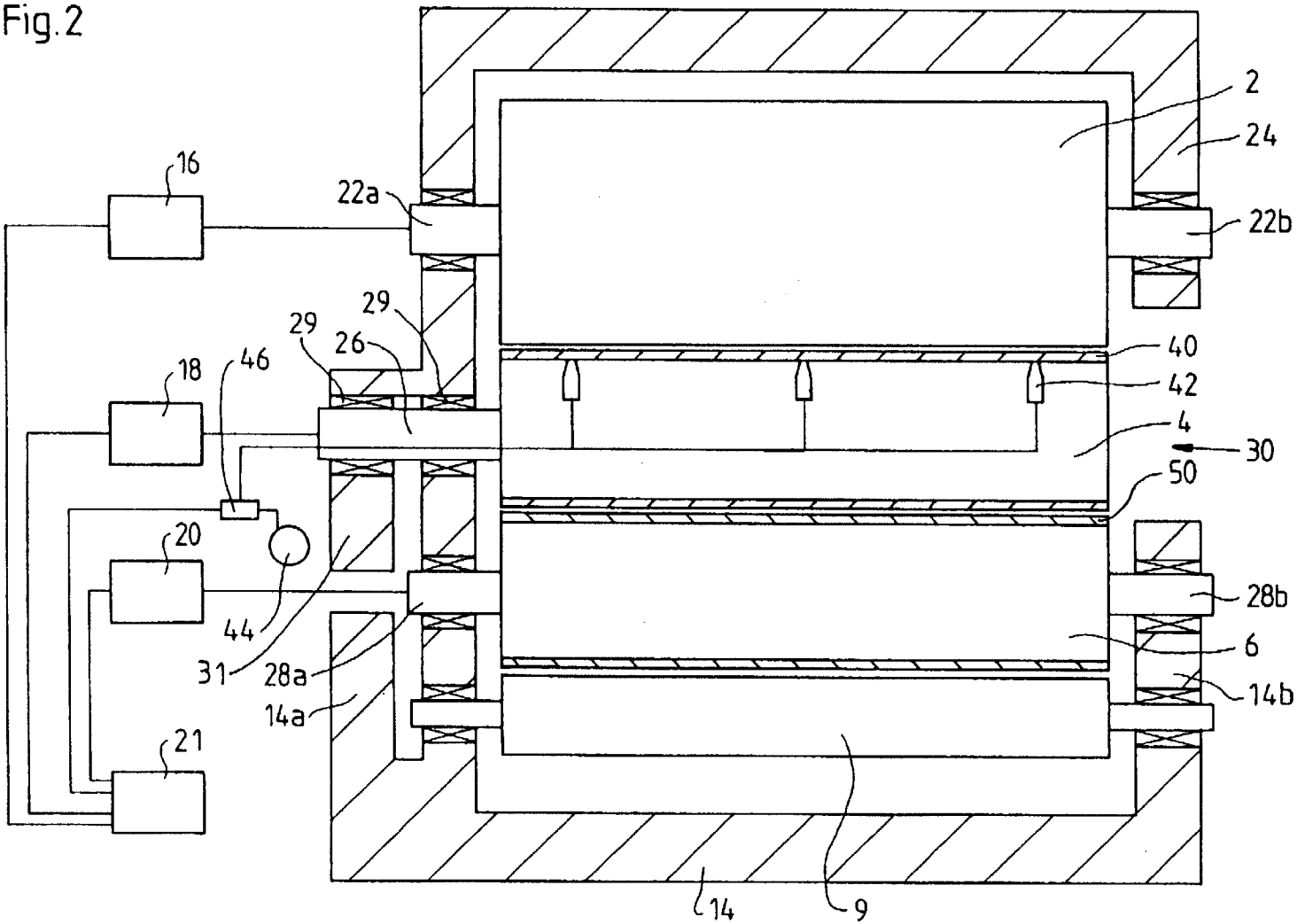
FIG. 2 shows a cross sectional view of the printing unit of FIG. 1 with a cantilevered blanket cylinder according to the present invention.
Figure 3:
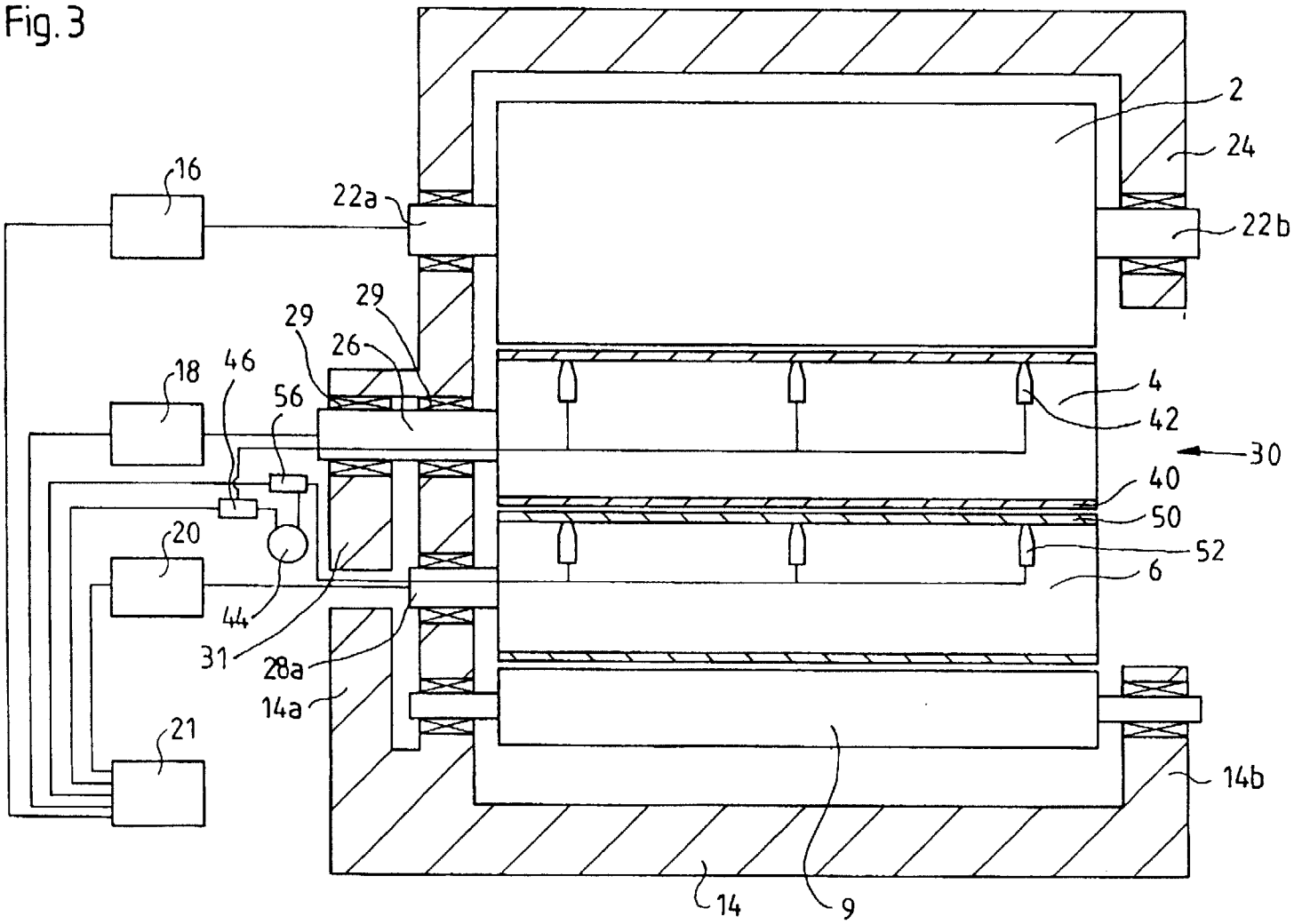
FIG. 3 shows a schematic cross sectional view of the printing unit of FIG. 1 with a cantilevered blanket cylinder and a cantilevered print cylinder in accordance with the present invention.

FIG. 2 shows the satellite printing press of FIG. 1 having blanket cylinders 4 which are cantilevered, and having print cylinders 6 which are supported on both ends. FIG. 3 shows the satellite printing press of FIG. 1 having blanket cylinders 4 and print cylinders 6 which are cantilevered. The cylinders 2, 4, 6 and rollers 9 are arranged in a housing 14 comprising a first housing section and a second housing section formed by side walls 14*a* and 14*b*, respectively.

As shown in FIGS. 2 and 3, the cylinders 2, 4 and 6 are each driven by a direct drive in the form of electric motors 16, 18, 20 and associated driving shafts connected to the cylinders. The motors 16, 18, 20 are connected to a central controlling unit 21 of the printing press 1 which preferably controls the speed of each of the motors 16, 18, 20 separately. However, the cylinders 2, 4, 6 can alternatively be driven from a common drive. For example, a central motor could drive all the cylinders 2, 4, 6 via conventional shafts and gear boxes, a gear train, or a belt and line shaft drive (not shown).

In accordance with a first embodiment of the present invention, the central impression cylinder 2 is rotatably mounted in the first and second side walls 14*a*, 14*b* of the housing 14 by a first and a second journal 22*a*, 22*b* and associated bearings which are arranged in the side walls 14*a*, 14*b* respectively. The portion of the second side wall 14*b* carrying the second journal 22*b* of the central impression cylinder 2 is formed by a support 24 which preferably extends downwardly from the top of the housing 14 as shown, for example, in FIGS. 1, 2 and 3.

In accordance with the embodiment of FIG. 2, the blanket cylinder 4 is rotatably cantilevered; i.e., it is supported only on one side at all times. Referring to FIG. 2, the blanket cylinder 4 is mounted in the first side wall 14*a* by a journal 26. The journal 26 is rotatably mounted within the first side wall 14*a* by a pair of bearings 29. Alternatively, a single large bearing can be substituted for the two bearings of FIG. 2. The print cylinder 6 is rotatably mounted in the first and second side wall 14*a* and 14*b* of the housing 14 via a first and a second journal 28*a* and 28*b* and associated bearings. A print form 50 is radially mounted on the print cylinder 6 in a known manner, e.g., magnetically or via a gap in the print cylinder. An opening 30 is provided in the second side wall 14*b* of the housing 14 to allow axial removal of a printing blanket 40.

In accordance with the embodiment of the invention shown in FIG. 3, the print cylinder 6, as well as the blanket cylinder 4 is cantilevered in the first side wall 14*a* in the same way as described above for the blanket cylinder 4. Both cylinders 4,6 are supported by the first side wall 14*a* via journals 28 and associated bearings. The opening 30 in the second side wall 14*b* is expanded to allow axial removal of both a print form 50 and printing blanket 40. In accordance with this embodiment, the print form 50 is configured to facilitate axial installation and removal, e.g. by constructing the print form as a sleeve. Thus, the print form 50 and printing blanket 40 can be quickly and easily be removed from the printing unit 1 by simply pulling them out of the housing 14 through the opening 30 formed in the second side wall 14*b* when the printing unit is not in operation.

In order to increase the strength of the housing 14, the second side wall 14*a* of the housing 14 can be completely or partially reinforced, particularly in the section where the cylinders 4 and 6 are cantilevered. In FIGS. 2 and 3, for example, the side wall 14*a* is shown as partially reinforced with an additional support 31 supporting the cantilevered cylinders.

Figure 4:
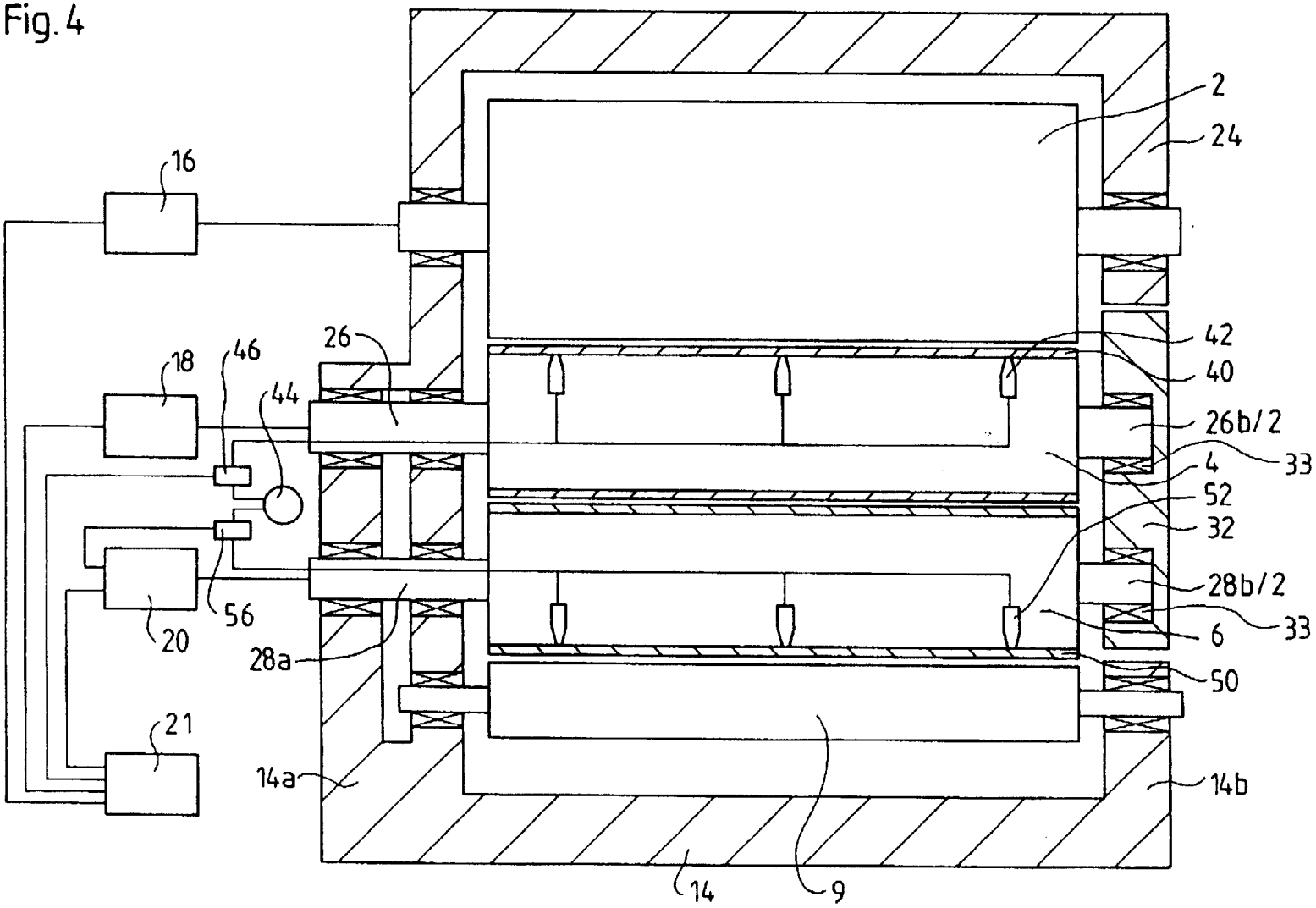
FIG. 4 shows a cross sectional view of the printing press of FIG. 1, in which the print cylinder and the blanket cylinder are additionally supported by a plate mounted in a second side wall.

In accordance with the embodiment of FIG. 4, the print and blanket cylinders 4, 6, are supported during printing within both side frame 14*a* and side frame 14*b*. During throw-off, however, the blanket cylinder 4 and/or the print cylinder 6 are supported only by side frame 14*a*. Therefore, as shown in FIG. 1, a side plate 32 is mounted in the opening 30, and supported in the side frame 14*b*. The plate 32 includes releasable clamps for clamping and releasing the cylinders 4, 6. In accordance with the present invention, bearings 33 may be permanently mounted in bearing housings on respective journals 26*b*/2 and 28*b*/2, and the releasable clamps configured to clamp and release the bearing housings. Alternatively, the bearings may be permanently mounted in the plate 32, and the releasable clamps configured to clamp and release the respective journals. The plate 32 is preferably pivotable about a vertically extending axis by a actuating device in order to automatically open and close the opening 30. An illustrative plate 32, including releasable clamps are described in more detail in U.S. Pat. No. 5,241,905 to Guaraldi.

In accordance with a further embodiment of the present invention, the blanket 40 on the blanket cylinder 4 is formed as a gapless sleeve which is preferably constructed in the manner described in U.S. Pat. No. 5,323,702. For easily mounting the sleeve-shaped blanket 40 on the blanket cylinder 4, at least one set of apertures 42 are arranged around the circumferential surface of the blanket cylinder 40 and are connected to a compressed air supply 44 via a valve 46. The valve 46, in turn, is actuated by the central control unit 21. When the printing press is stopped, the control unit 21 actuates the valve 46 and compressed air is supplied from the air supply 44 through the apertures 42, thereby expanding the blanket 40. Once expanded, the blanket can be easily removed from the blanket cylinder 4 through an opening formed in the side wall 14*b* of the press. FIG. 2 shows three sets of apertures 42 across the length of the cylinder 4.

In a further embodiment of the present invention, the print forms 50 mounted on the print cylinder 6 are formed as a sleeve. The mounting of the sleeve-shaped print form 50 can be performed in the same manner described above for the blanket 40. The print form 50 is installed and removed through the opening formed in the side wall 14*b* of the printing unit 1. Compressed air is transmitted from a compressed air supply 44, through a valve 56 actuated by the central control unit 21, and out through apertures 52 on the circumferential surface of the print cylinder 6.

In accordance with a further embodiment of the present invention, a plurality of sleeve shaped blankets or print forms 40, 50 can be mounted on each respective blanket or print cylinder 4,6. The apertures 42, 52 are arranged so that at least one set of apertures 42, 52 are under each respective blanket or print form 40, 50 as it is slid onto the cylinder 4, 6 or removed from the cylinder 4, 6. Therefore, the spacing of the apertures 42, 52 is arranged such that the distance between two sets of apertures is slightly less than the width of the respective blankets or print forms 40, 50.

In accordance with a preferred embodiment of the present invention, however, the apertures 42, 52 are arranged so that at least two sets of apertures 42, 52 are under each respective blanket or print form 40, 50 as it is slid onto the cylinder 4, 6 or removed from the cylinder 4, 6. In accordance with this embodiment, the spacing of the apertures 42, 52 is arranged such that the distance between two sets of apertures is slightly less than half the width of the respective blankets or print forms 40, 50.

Figure 5:
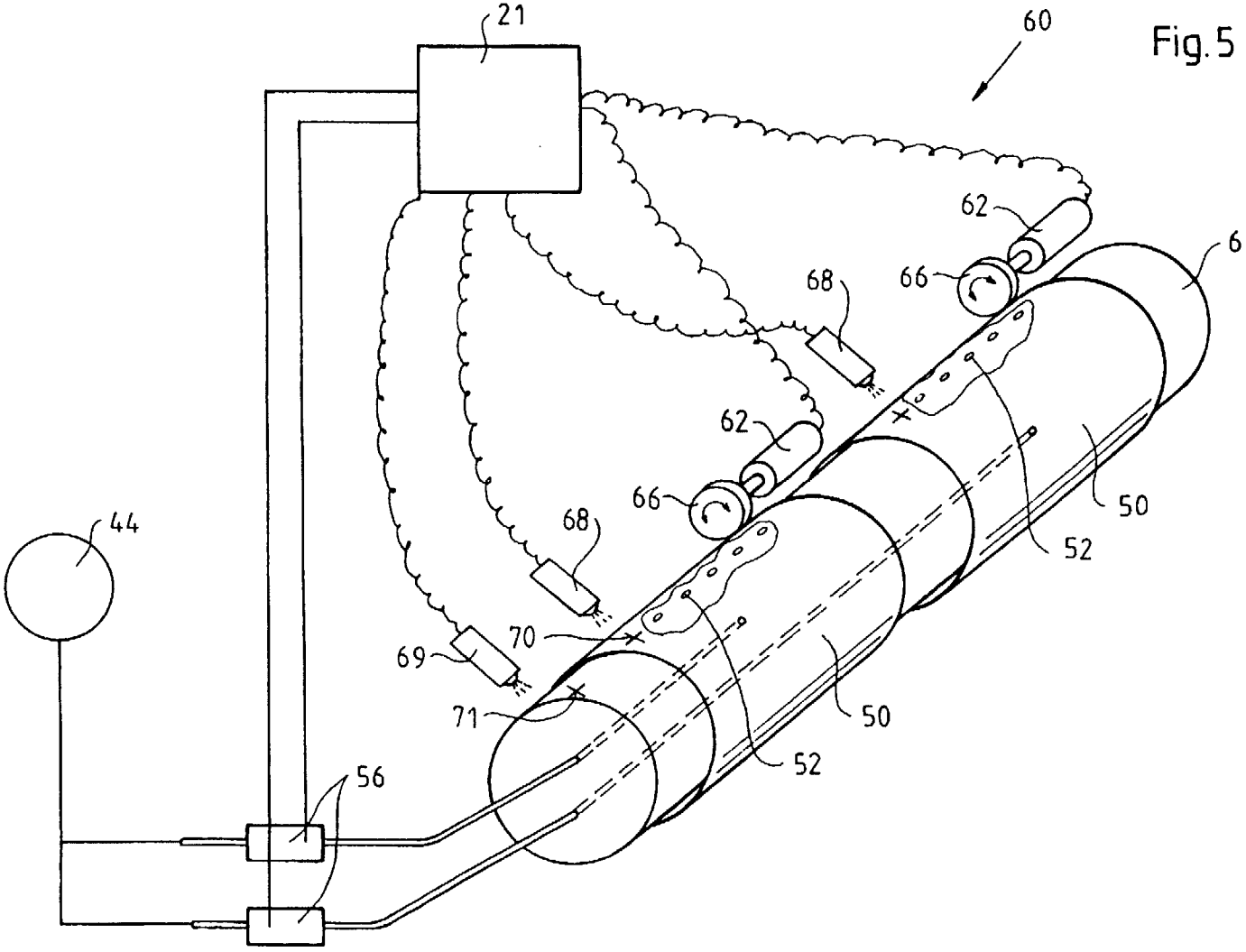
FIG. 5 shows an automatic register adjustment system according to the present invention.

In accordance with the embodiment of the present invention shown in FIG. 5, an automatic register adjustment system 60 for the sleeve-shaped print forms 50 can provide automatic register adjustment both while the printing unit 1 is running and while the printing unit is stopped. As shown in FIG. 5, the system 60 comprises an electric motor 62, preferably a stepper motor, which is controlled, for example, by the central control unit 21 of the printing press. While the compressed air system is activated and the print form is in its expanded state, the motor 62 is controlled to automatically rotate the sleeve shaped print form 50 via a wheel 66 which contacts the outer surface of the print form 50. The automatic register adjustment system 60 further comprises a first sensor 68 connected to the unit 21, for sensing the position of the print form 50, e.g., by detecting the a first mark 70 located on the print form 50. Preferably, the mark 70 is located at one end of the print form 50. In addition, in accordance with a further embodiment of the invention, the air pressure applied through the apertures 52 is less than the air pressure used for axial removal of the print form 50, but enough to overcome the friction between the print form 50 and the print cylinder 6 and allow automatic register.

A second sensor 69 is also connected to the unit 21 for sensing the position of the cylinder 6, e.g., by detecting the a second mark 71 located on the cylinder 6. The second mark 71 provides a reference position to which the first mark 70 is tracked, and proper registry is defined as a desired displacement between the first and second marks. For example, the system 60 could be configured to maintain the first mark 0,45, or 90 degrees ahead of the second mark.

The first and second sensors 68, 69 may be of any known construction, e.g., optical sensors or proximity switches. Moreover, the first sensor need not be of the same construction as the second sensor.

In the illustrative examples set forth below, the system 60 is configured to define proper registry as a 0 degree displacement between the first and second marks. An illustrative procedure for providing circumferential register while the press is stopped is as follows: First, the cylinder 6 is rotated until the second sensor 69 detects that the second mark 71 has reached a desired reference position. Then, the compressed air is engaged to expanded the print form 50, and the control unit 21 drives the electric motor 62 until the first sensor 68 senses the first mark 70 and switches off the compressed air. When the compressed air is switched off, the print form 50 contracts and tightly clamps on the cylinder 6. The automatic register adjustment system 60 allows register adjustment of one, two or more print forms 50 mounted on one cylinder 6, by providing a respective number of electric motors 62, wheels 66, sensors 68, 69 and marks 70, 71. As shown in FIG. 5, the apertures 52 associated with each sleeve shaped print form 50 of the print cylinder 6 can be connected to the compressed air supply 44 via separately actuated valves 56, so that the print forms 50 can be adjusted independently.

An illustrative procedure for providing registry while the press is running is as follows: First, the press is taken "off impression"; i.e., the blanket cylinder 4 is taken out of contact with the print cylinder 6. Then, while the cylinders 4, 6 are still rotating, the compressed air is engaged, and the print form 50 is expanded. Then, the electric motor 62 at first rotates the sleeve 50 with the same speed and in the same direction as the print cylinder 6, so that there is substantially no relative speed differential between the sleeve shaped print form 50 and the cylinder 6. Then the control unit 21 monitors the output of the first and second sensors 68, 69. If the control unit 21 detects a time differential between the triggering of the first and second sensors, then the speed of the motor 62 is reduced or increased until the time differential is eliminated. When using a stepper motor 62 controlled by the unit 21, the reduction or increase of the speed of the motor 62 can be achieved by respectively increasing or decreasing the number of steps per second.

Figure 6:
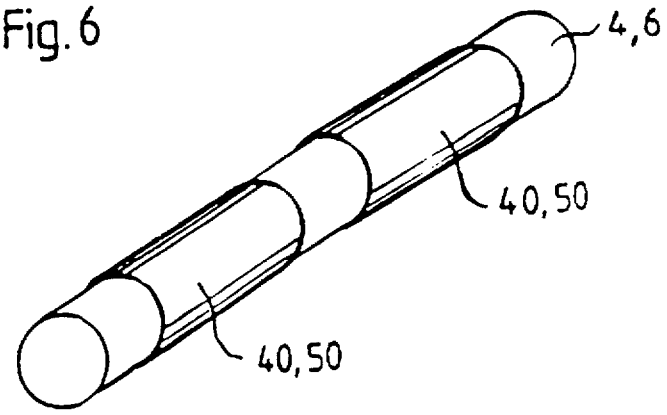
FIG. 6 shows a print or blanket cylinder with two sleeves mounted thereon.
Figure 7:
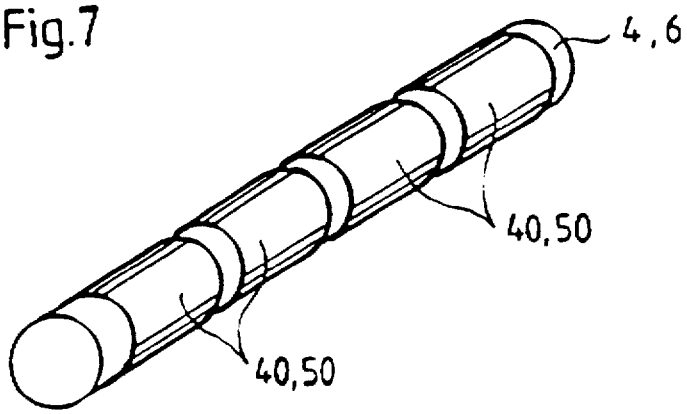
FIG. 7 shows a print or blanket cylinder with four sleeves mounted thereon.

According to the embodiment of the invention shown in FIGS. 6 and 7, two or more blankets 40 or print forms 50 may be mounted on a single blanket or print cylinder 4, 6. Using two or more print forms 50 allows the print jobs to be quickly and easily changed. This is particularly useful when printing newspapers since this application requires frequent changes to the image being printed. By using two or more blankets 40 on one blanket cylinder 4, it is possible to exchange these blankets periodically. Exchanging blankets 40 is advantageous when, for example, a blanket has been printing the same image for a long period of time. By exchanging blankets, different portions of the blankets will be used for printing, thereby enhancing print quality and blanket life. In addition, if damage to the blankets occurs on only one part of the blanket cylinder, it is possible to simply exchange the one blanket which has been damaged, while leaving the other blankets in place on the cylinders. For example, if a single blanket is used, damage to one page of a 38" web will require replacement of a full 38" blanket. In contrast, if two 19" blankets are used, damage to one page of the web will only require replacement of one 19" blanket, thereby reducing the cost resulting from the damage.

Figure 8:
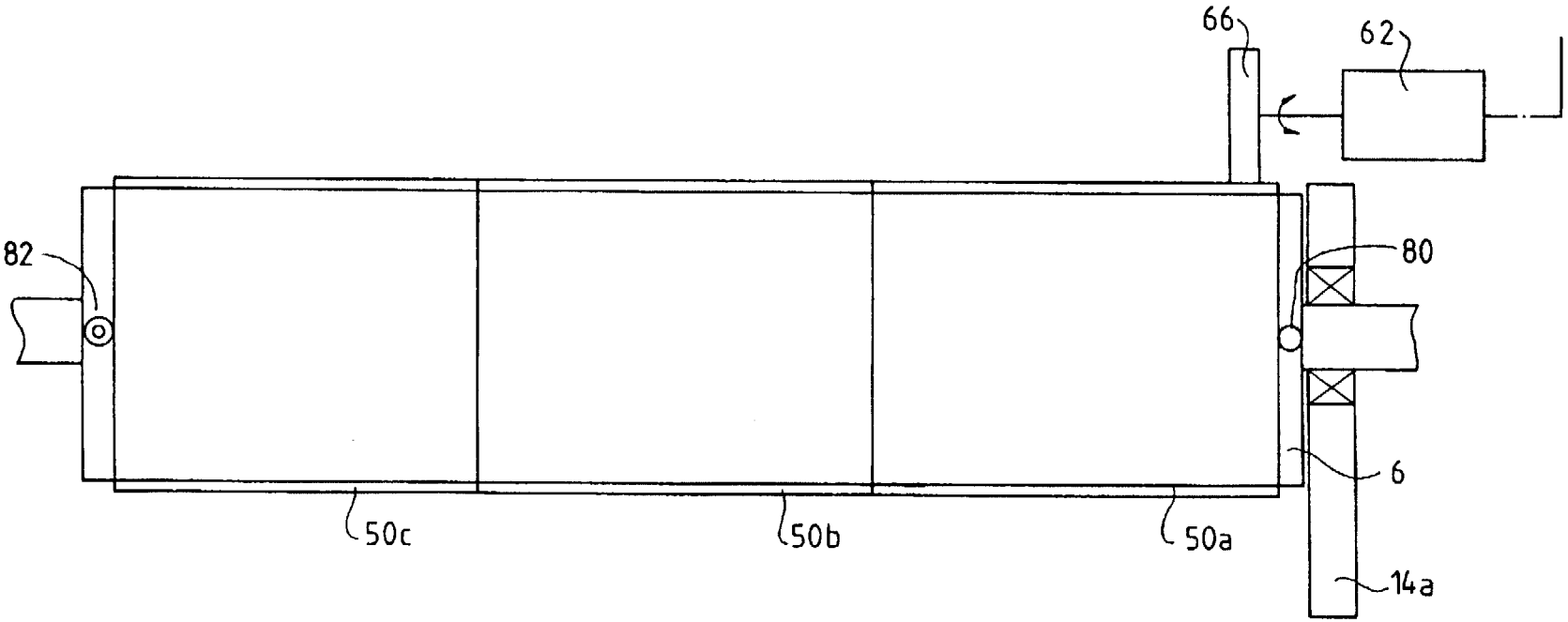
FIG. 8 shows a print cylinder with three sleeve-shaped print forms mounted thereon, and having a pin for lateral register adjustment.
Figure 9:
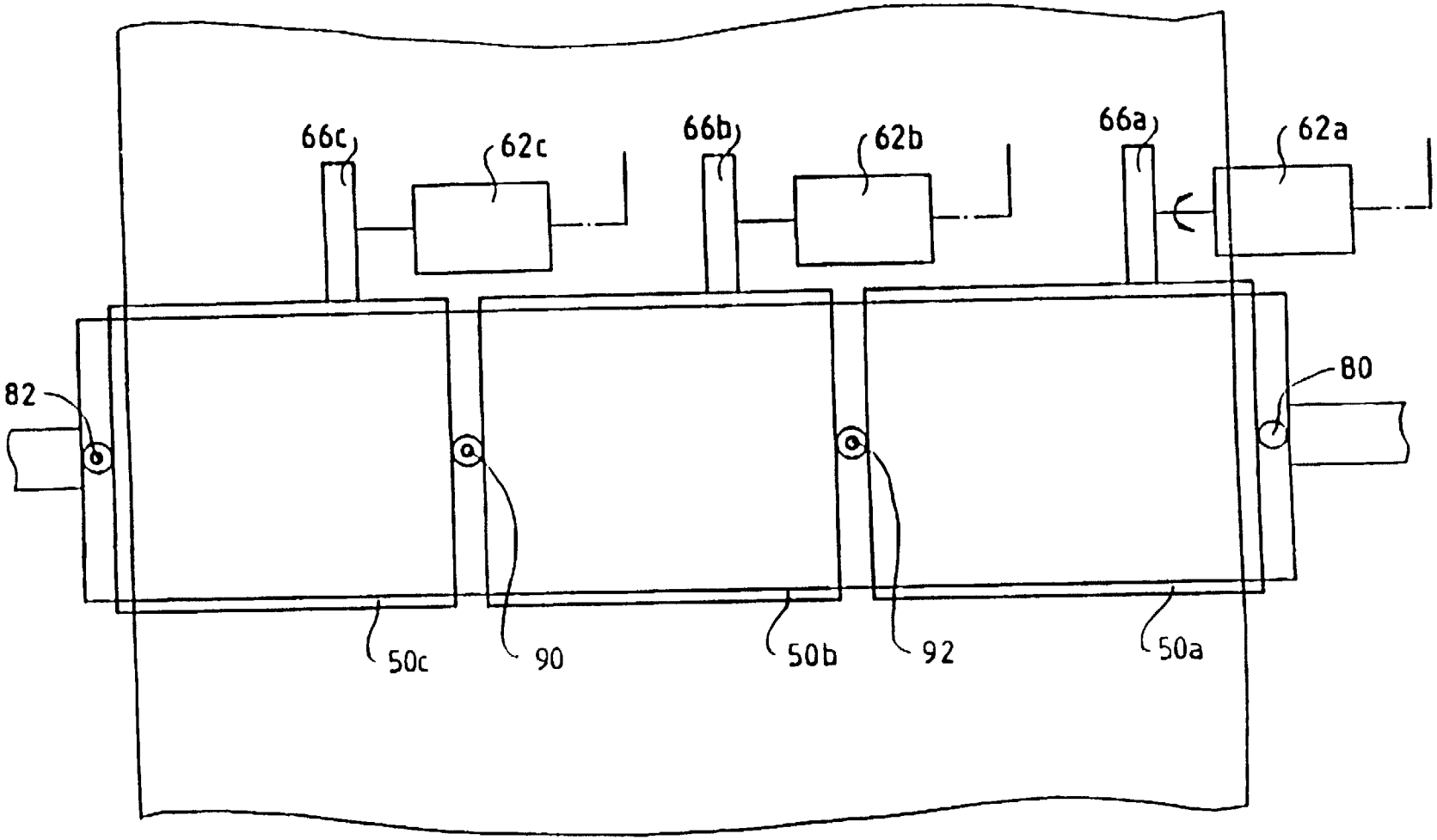
FIG. 9 shows a print cylinder with three sleeve-shaped print forms having three cone-shaped pins for lateral register adjustment.
Figure 10:
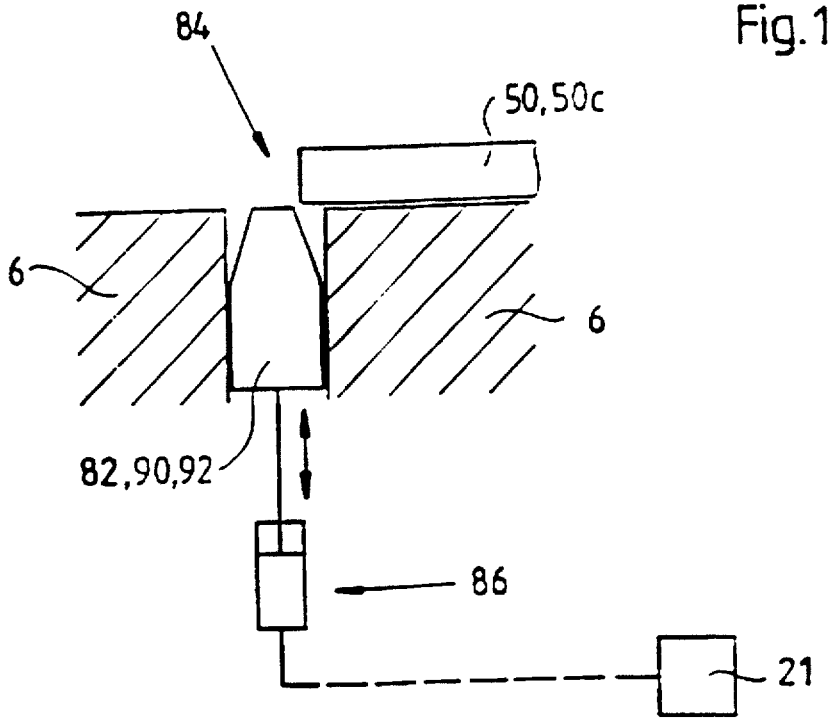
FIG. 10 shows a view of a pin and corresponding actuating mechanism for moving the pin.

In accordance with the embodiment of the invention shown in FIGS. 8, 9 and 10, to provide lateral register adjustment of one, two or more print forms 50 (e.g. the three print forms 50*a*, 50*b*, 50*c* shown in FIG. 8 and 9), pins 80 are disposed at least at one end of the print cylinder 6. The pin 80 shown in FIG. 8 is preferably a straight pin which is located at the end of the print cylinder 6 mounted in housing 14(*a*). The pin 80 provides for a precise stop and positioning of the print form 50*a* when sliding the print form 50*a* onto the print cylinder 6, and the pin 80 also provides for a lateral register adjustment of the print form 50*a* when the it is being rotated by the electric motor 62*a* of the register adjustment system 60.

In the embodiment of the invention shown in FIG. 8, there can further be provided a second pin 82 which can be disposed within a hole 84 arranged in the surface of the print cylinder 6 and which is preferably radially moveable out of the hole 84 by actuating mechanism 86. The actuating mechanism 86 can e.g. be a pneumatic cylinder, a solenoid drive or a manually activated leaver mechanism which radially moves the pin 82 out of the hole 84 after a single print form 50 or a plurality of print forms 50, e.g. the print forms 50*a*, 50*b*, 50*c*, have been moved onto the print cylinder 6. In the preferred embodiment of the invention, the top of the pin 82 is preferably cone-shaped or tapered, and the corresponding end portion of the print form 50 or 50*c* partially covers the hole 84, such that the print form 50 or 50*c* is automatically moved further onto the print cylinder 6 as the pin 82 extends, until the movement of the print form is stopped by the first pin 80 provided at the other end of the plate cylinder 6. A corresponding hole may be provided in the blanket cylinder to receive the pin 82 as it extends. Thus, the lateral register of the plate sleeves 50 is precisely and easily adjustable. In this embodiment of the invention, the adjoining edges of two neighboring print forms 50, e.g. the print forms 50*a*, 50*b*, 50*c* of FIG. 8 are arranged edge to edge, so that the lateral register of the sleeves 50*a*, 50*b*, 50*c* is adjusted only by the straight pin 80 and the tapered pin 82.

In accordance with a still further embodiment of the present invention shown in FIG. 9, additional pins 90, 92 are provided between two adjoining print forms 50, e.g. the print forms 50*a* and 50*b* or 50*b* and 50*c* for adjusting the lateral register of each respective print forms 50*a*, 50*b*, 50*c*, separately. The pins 90, 92 are preferably of the same construction, and actuated in the same manner, as pin 84 to provide a lateral movement of adjacent print forms.

In addition, the pin 80 may also be movably mounted within a respective hole in the print cylinder and independently controlled by an actuating mechanism 86 to provide a lateral movement of adjacent print forms.

While the pins 80, 82, 90, 92 are preferably cone-shaped, they may also of any other desired shape, e.g., cylindrical, rectangular, or octagonal.

The actuating mechanisms 86 are preferably controlled by the central control unit 21 of the printing press and can be connected to the compressed air supply 44 in the case of pneumatic cylinders. When sliding the one or more print forms 50 onto the cylinder 6, the pins 82, 90, 92 are completely withdrawn into their respective holes 84 by the actuating means 86, and they are moved out of the respective holes 84 after the sleeves 50*a*, 50*b*, 50*c* have been moved onto the cylinder 6 while the compressed air from the apertures 52 is engaged and the print forms 50*a*, 50*b*, 50*c* are expanded. In accordance with a further embodiment of the present invention, slots are formed at each end of the print forms for receiving the tapered pins 82, 90, 92.

While the mechanisms for controlling the circumferential and lateral register have been described in the above embodiments with respect to a satellite printing unit having a central impression cylinder, these mechanisms can also be used on printing units which do not utilize a central impression cylinder.

What is claimed is:

1. An offset printing unit including an automatic register system, comprising:

a print cylinder having a sleeve-shaped print form mounted thereon, a first target located on an outer surface of the print form, a second target located on an outer surface of the print cylinder, a plurality of apertures located on the outer surface of the print cylinder;

a sleeve expansion mechanism coupled to the print cylinder, the sleeve expansion mechanism transmitting compressed air through the plurality of apertures to radially expand the print form;

a motor having a wheel mounted thereon, the wheel contacting the print form when the print form is in its expanded state;

a first sensor mounted adjacent to the print cylinder for detecting the first target;

a second sensor mounted adjacent to the print cylinder for detecting the second target;

a control unit having a first input connected to the first sensor, a second input connected to the second sensor, and an output connected to the motor, the control unit controlling the circumferential position of the print form relative to the print cylinder as a function of the signals received from the first and second sensors.

2. An offset printing unit including an automatic register system, comprising:

a housing including a first and a second housing section, a central impression cylinder including a first journal and a second journal, the first journal rotatably supported in the first housing section and the second journal rotatably supported in the second housing section, a web at least partially wound around the central impression cylinder;

at least two blanket cylinders in rolling engagement with the central impression cylinder, each blanket cylinder having a first end and a second end, each blanket cylinder including a third journal at the first end, the third journal of each blanket cylinder being rotatably supported in the first housing section, the second end of each blanket cylinder being unsupported when the printing unit is not in operation; and at least two print cylinders, each print cylinder disposed in rolling engagement with a respective one of the at least two blanket cylinders, each print cylinder having a sleeve-shaped print form mounted thereon, a first target located on an outer surface of each print form, a second target located on an outer surface of each print cylinder, a plurality of apertures located on the outer surface of each print cylinder;

a sleeve expansion mechanism coupled to each print cylinder, the sleeve expansion mechanism transmitting compressed air through the plurality of apertures to radially expand each print form;

at least two motors each having a wheel mounted thereon, each wheel contacting a respective print form when the print form is in its expanded state;

a first sensor mounted adjacent to each print cylinder for detecting the first target;

a second sensor mounted adjacent to each print cylinder for detecting the second target;

a control unit having inputs connected to the first sensors and the second sensors, and having outputs connected to the motors, the control unit controlling the circumferential position of the print forms relative to the print cylinders as a function of the signals received from the first and second sensors.

3. A printing unit including an automatic register system, comprising:

a print cylinder having at least two sleeve-shaped print forms mounted thereon, a first target located on an outer surface of each print form, a second target located on an outer surface of a print cylinder, a plurality of apertures located on the outer surface of the print cylinder;

a sleeve expansion mechanism coupled to the print cylinder, the sleeve expansion mechanism transmitting compressed air through the plurality of apertures to radially expand the print forms;

at least two wheels, each wheel contacting a corresponding print form when the corresponding print form is in its expanded state, the at least two wheels driven by at least one motor;

at least two first sensors mounted adjacent to the print cylinder for detecting corresponding first targets;

a second sensor mounted adjacent to the print cylinder for detecting the second target;

a control unit having a first input connected to the first sensors, a second input connected to the second sensor, and an output connected to the at least one motor, the control unit controlling the circumferential position of the print forms relative to the print cylinder as a function of the signals received from the first and second sensors.

4. The printing unit according to claim 3, wherein the at least one motor includes a separate motor for driving each of the at least two wheels, and wherein the control unit independently controls each of the separate motors to independently control the circumferential position of each of the print forms.

* * * * *